US006203956B1

(12) United States Patent
Urano et al.

(10) Patent No.: US 6,203,956 B1
(45) Date of Patent: Mar. 20, 2001

(54) ELECTROPHOTOGRAPHIC TONER AND IMAGE-FORMING METHOD

(75) Inventors: Chisato Urano; Katsumi Daimon; Masato Mikami; Norihito Fukushima, all of Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/519,462

(22) Filed: Mar. 6, 2000

(30) Foreign Application Priority Data

Apr. 7, 1999 (JP) ..... 11-100583

(51) Int. Cl.[7] ..... G03G 9/087; G03G 13/20
(52) U.S. Cl. ..... 430/109; 430/111; 430/124
(58) Field of Search ..... 430/109, 111, 430/124

(56) References Cited

FOREIGN PATENT DOCUMENTS

| | | |
|---|---|---|
| 023910 | 11/1967 | (JP) . |
| 50-134652 | 10/1975 | (JP) . |
| 51-023354 | 7/1976 | (JP) . |
| 1-163756 | 6/1989 | (JP) . |
| 1-163757 | 6/1989 | (JP) . |
| 2-079860 | 3/1990 | (JP) . |
| 4-081770 | 3/1992 | (JP) . |
| B2-4-024702 | 4/1992 | (JP) . |
| B2-4-024703 | 4/1992 | (JP) . |
| 4-155351 | 5/1992 | (JP) . |
| B-5-044032 | 7/1993 | (JP) . |
| 9-329917 | 12/1997 | (JP) . |

OTHER PUBLICATIONS

M. Koishi, *Biryushi Sekkei*, Kogyo Chosakai, pp. 73–87, 1991.

T. Kondo, *Microcapsule–Its Performance and Application*, Noppon Kikaku Kyokai, pp. 4–31, 1991.

*Primary Examiner*—Roland Martin
(74) *Attorney, Agent, or Firm*—Oliff & Berridge, PLC

(57) ABSTRACT

An electrophotographic toner containing a binder resin and a colorant, wherein at the angular frequency of 1 rad/sec and 30° C., a storage elastic modulus (G'30) is at least $1\times10^5$ Pa and a loss elastic modulus (G"30) is at least $1\times10^5$ Pa; a melting point is in the temperature region of 45 and 110° C.; when a common logarithm of G' is plotted against the temperature and G' at melting point +20° C. is represented by G' (Tm+20) and G' at melting point +50° C. is represented by G' (Tm+50) the condition of the following formula (1) is satisfied $$|logG'(Tm+20)-logG'(Tm+50)|\leqq 1.5 \quad (1);$$

and when a common logarithm of G" is plotted against the temperature and G" at melting point +20° C. is represented by G" (Tm+20) and G" at melting point +50° C. is represented by G" (Tm+50), the condition of the following formula (2) is satisfied $$|logG''(Tm+20)-logG''(Tm+50)|\leqq 1.5 \quad (2).$$

The electrophotographic toner is good in a low-temperature fixing property and an offset resistance, has a wide fixing latitude and is capable of oilless fixing.

14 Claims, 1 Drawing Sheet

ELECTROPHOTOGRAPHIC TONER AND IMAGE-FORMING METHOD

BACKGROUND OF THE INVENTION

1. Field of the Invention

The present invention relates to a toner appropriate for an electrophotographic process of a copier, a printer or a facsimile and an image-forming method using the same. More specifically, it relates to an electrophotographic toner which is preferably used in a color copier.

2. Description of the Related Art

As a photographic method, many methods are known as described in Japanese Patent Publication No. 23910/1967. Generally, a fixed image is formed through plural steps of electrically forming a latent image on a photoreceptor using a photoconductive material by various methods, developing this latent image with a toner, transferring the toner latent image of the photoreceptor on a material for transfer such as paper through or not through a middle transfer body and then fixing this transferred image by heating, pressing or heat-pressing or with a solvent steam. The toner remaining on the photoreceptor is cleaned by various methods as required, and the plural steps are repeated.

In this fixing technique, a heating roller fixing method in which a transfer body having a toner image is inserted between a pair of rollers, a heating roller and a pressure roller for fixing is a general method. Further, as the same type of the technique, changing one or both of the rollers to belt(s) is also known.

In these methods, in comparison with other fixing methods, a fast fixed image is obtained at high speed, an energy efficiency is high, and the environmental pollution owing to evaporation of a solvent is reduced. However, since the toner image is brought into direct contact with rollers or belts, so-called offset in which a part of the toner is adhered to rollers or belts tends to occur in the fixing. Especially when a temperature of a fixing device is high, a cohesive force of a molten toner is decreased, and the offset is liable to occur.

Further, in order to decrease an amount of energy used, it is required that the fixing can be conducted at a lower temperature. Especially, in recent years, it is desired that the current passage through the fixing device is stopped except when it is used for complete energy saving. Thus, the temperature of the fixing device is required to be elevated to a use temperature immediately after the current passage. To this end, it is preferable to minimize a heat capacity of the fixing device. However, in this case, an amplitude of the temperature of the fixing device tends to be increased more than as usual. That is, the overshoot of the temperature after the start-up of the current passage is increased, while the temperature is decreased owing to passage of paper. Further, when paper having a smaller size than the fixing device is continuously passed, a difference in temperature between a paper passage portion and a non-paper-passage portion is also increased. Especially, in a high-speed copier or printer, a power capacity is sometimes insufficient, and this tendency is strong. Accordingly, a toner having a so-called wide fixing latitude in which the fixing is conducted at a low temperature and offset does not occur up to a high temperature region has been in demand.

In order to decrease the fixing temperature of the toner, the use of a crystalline resin as a binder resin is proposed in Japanese Patent Publication Nos. 24702/1992 and 24703/1992 and Japanese Patent Laid-Open No. 329917/1997.

Although this method can decrease the fixing temperature, an offset resistance is not necessarily satisfactory. That is, since the molten toner permeates paper, occurrence of offset can be prevented to some extent. However, there arises a problem that since the molten toner permeates paper too much, a uniform high-density image is not obtained.

Meanwhile, for preventing occurrence of offset, it is known that a resin having an appropriate molecular weight distribution which is obtained by blending a low polymer with a high polymer is used as a binder resin of a toner (Japanese Patent Laid-Open No. 134652/1975). Also known is the use of a crosslinked resin (Japanese Patent Publication No. 23354/1976). Nevertheless, these methods cannot provide a fixing latitude which is wide enough to meet the needs in recent years. Offset hardly occurs by using a large amount of a high polymer or a crosslinked polymer, but the fixing temperature is increased. Meanwhile, when a molecular weight of a low polymer is decreased or an amount thereof is increased for decreasing the fixing temperature, a temperature at which offset occurs is decreased. Further, the fixing temperature can also be decreased by decreasing a glass transition temperature of a binder resin or using a plasticizer. However, a so-called blocking phenomenon of cohering and solidifying a toner during storage or in a developing device occurs.

In order to solve these problems, there are a large number of proposals on a technique in which a crystalline polymer is used as a binder resin not singly but in combination with an amorphous polymer as described below. For example, the combined use of a crystalline polymer and an amorphous polymer is described in Japanese Patent Laid-Open No. 79860/1990. A polymer obtained by chemically combining a crystalline polymer with an amorphous polymer is described in Japanese Patent Laid-Open Nos. 163756/1989, 163757/1989, 81770/1992, 155351/1992 and 44032/1993.

However, when the amount of the amorphous polymer is larger than that of the crystalline polymer, the amorphous polymer is a continuous phase, and the crystalline polymer is a disperse phase. In this case, since the crystalline polymer is covered with the amorphous polymer, the crystalline polymer is not problematic. Meanwhile, since the melting of the overall toner is controlled by the softening point of the amorphous polymer, a low-temperature fixing property is not provided.

As the contradictory characteristics, namely, the decrease in the fixing temperature and the prevention of offset are thus required, a toner that actually satisfies well the characteristics has not yet been obtained.

SUMMARY OF THE INVENTION

The invention has been made in consideration of these problems. The invention provides an electrophotographic toner which is good in a fixing property at a low temperature, has a wide fixing latitude, is good in an offset resistance, can dispense with the use of a release agent or reduce an amount thereof and reduces adhesion of oil to a material for transfer and an image after fixing. Further, the invention provides an image-forming method using this electrophotographic toner, which can downsize a fixing device or reduce a cost of the device and can form a high-quality image with a small amount of energy.

The electrophotographic toner of the invention is a toner containing a binder resin and a colorant, in which at the angular frequency of 1 rad/sec and 30° C., a storage elastic modulus (G'30) is at least $1\times10^5$ Pa and a loss elastic modulus (G"30) is at least $1\times10^5$ Pa; a melting point is in the temperature region of 45 and 110° C.; the values of the storage elastic modulus (G') and the loss elastic modulus (G") have an area which is changed by two or more figures at a temperature of 10° C.; when a common logarithm of the storage elastic modulus is plotted against the temperature and the storage elastic modulus at melting point +20° C. is represented by G' (Tm+20) and the storage elastic modulus at melting point +50° C. is represented by G' (Tm+50), the condition of the following formula (1) is satisfied $$|logG'(Tm+20)-logG'(Tm+50)|\leqq 1.5 \quad (1);$$

and when a common logarithm of the loss elastic modulus is plotted against the temperature and the loss elastic modulus at melting point +20° C. is represented by G" (Tm+20) and the loss elastic modulus at melting point +50° C. is represented by G" (Tm+50), the condition of the following formula (2) is satisfied $$|logG''(Tm+20)-logG''(Tm+50)|\leqq 1.5 \quad (2).$$

BRIEF DESCRIPTION OF THE DRAWING

The invention will be described more specifically with reference to the accompanying drawing, in which.

DETAILED DESCRIPTION OF THE INVENTION

Figure 1:
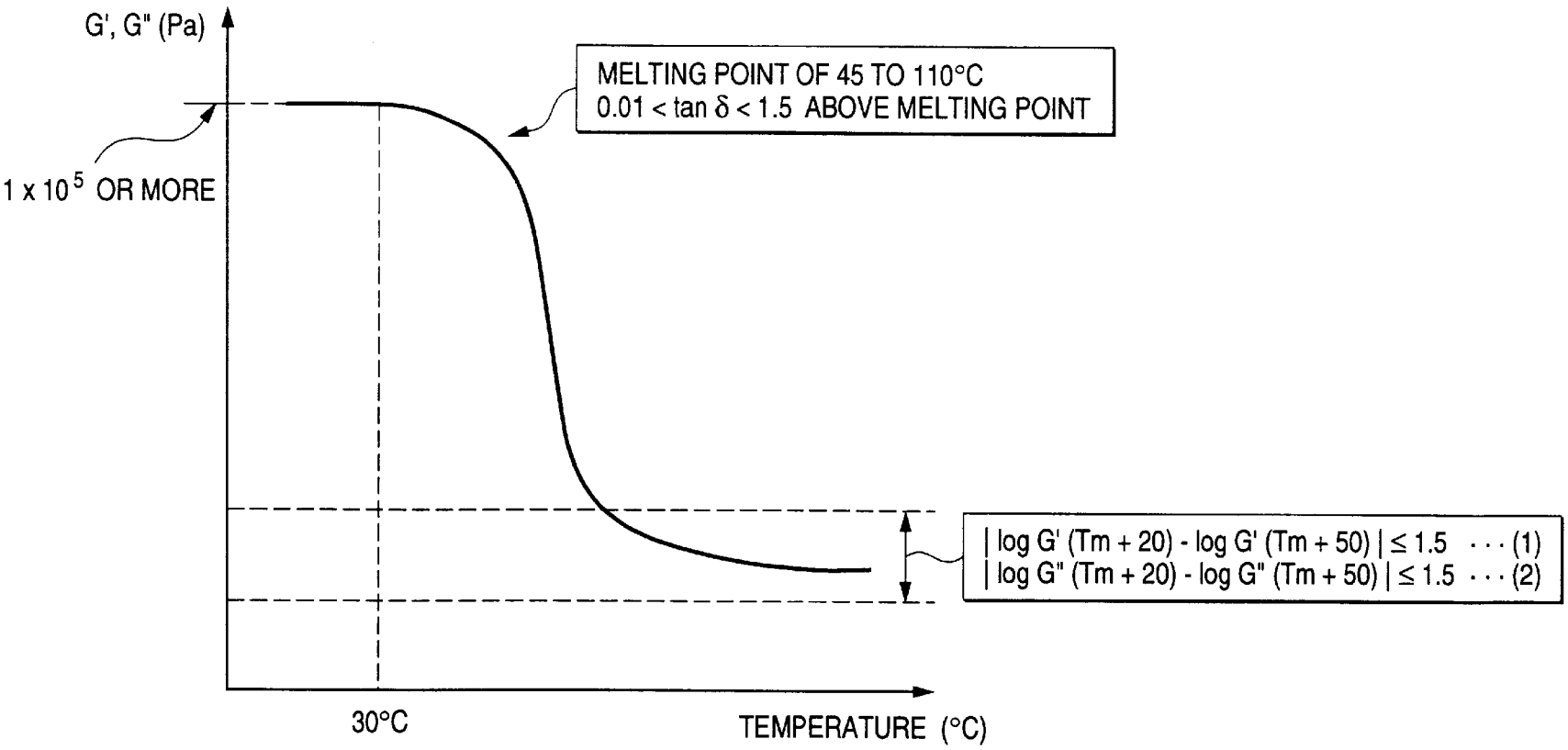
FIG. 1 is a graph showing characteristics of a crystalline resin appropriate as a binder resin of a toner in the invention.

The toner of the invention has to have a sufficient hardness at room temperature. Specifically, with respect to a kinematic viscoelasticity, it is required that at the angular frequency of 1 rad/sec and 30° C., the storage elastic modulus (G'30) is at least $1\times10^5$ Pa and the loss elastic modulus (G"30) is at least $1\times10^5$ Pa. In case that at the angular frequency of 1 rad/sec and 30° C., the storage elastic modulus (G'30) is less than $1\times10^5$ Pa and the loss elastic modulus (G"30) is less than $1\times10^5$ Pa, the toner particles are deformed by a pressure or a shearing force given from a carrier when mixed with a carrier in a developing device, making it impossible to maintain stable charge-developing characteristics. Further, when the toner on the latent image holding body is cleaned, it is deformed by a shearing force given from a cleaning blade, and insufficient cleaning occurs. When at the angular frequency of 1 rad/sec and 30° C., the storage elastic modulus (G'30) is at least $1\times10^5$ Pa and the loss elastic modulus (G"30) is at least $1\times10^5$ Pa, the characteristics are stable even in the use of the toner in a high-speed machine.

Further, it is advisable that a crystalline resin having a crosslinked structure is used as a toner binder resin having such characteristics. The crosslinked structure can prevent excessive permeation of the toner in a material for transfer such as paper and provide an electrophotographic toner having a wide fixing latitude.

As an index by which to judge whether a resin is appropriate as a binder resin of the invention, it is mentioned that a binder resin contains a crosslinked ingredient. That is, a crystalline resin having a crosslinked structure appropriate for the toner of the invention contains an ingredient that is not dissolved but swollen in an organic solvent.

Further, in the toner of the invention, it is preferable that a loss tangent tanδ at melting point +20° C. satisfies tanδ<1.5 at the angular frequency of 1 rad/sec. When the loss tangent tanδ above the melting point satisfies tanδ<1.5 at the angular frequency of 1 rad/sec, the excessive permeation in the material for transfer such as paper can be prevented, and the electrophotographic toner composition which has the wide fixing latitude and which gives the stable fixed image can be provided. It is more preferable that the loss tangent tanδ satisfies 0.01<tanδ<1.

The invention is described in more detail below.

In the toner of the invention, it is required that when a common logarithm of the storage elastic modulus is plotted against the temperature and the storage elastic modulus at melting point +20° C. is represented by G' (Tm+20) and the storage elastic modulus at melting point +50° C. is represented by G' (Tm+50), the following formula (1) is satisfied $$|logG'(Tm+20)-logG'(Tm+50)|\leqq 1.5 \quad (1),$$

and when a common logarithm of the loss elastic modulus is plotted against the temperature and the loss elastic modulus at melting point +20° C. is represented by G" (Tm+20) and the loss elastic modulus at melting point +50° C. is represented by G" (Tm+50), the following formula (2) is satisfied $$|logG''(Tm+20)-logG''(Tm+50)|\leqq 1.5 \quad (2).$$

Consequently, the occurrence of offset can be prevented. This index indicates that the temperature dependency above the melting point is moderate and a viscoelasticity that decreases along with a temperature according to melting of crystals has a point of inflection, meaning that the temperature dependency of the viscoelasticity is more reduced. Further, at least one of G' (Tm+20) and G" (Tm+20) is preferably at least 10 Pa, more preferably at least 100 Pa.

FIG. 1 is a graph showing characteristics of a binder resin having a crosslinked structure, which is appropriate as a binder resin of the toner of the invention.

Thus, in the binder resin of the invention, the abrupt decrease in the viscoelasticity is observed at the melting point in the temperature region of 45 to 110° C., and the modulus becomes stable in the predetermined range. Accordingly, even when the temperature is high in the fixing, the viscosity is not decreased more than as required, and the permeation in paper and the offset can be prevented.

In the invention, with respect to a hardness of a material contained in the toner, other than the binder resin, at the angular frequency of 1 rad/sec and 30° C., the storage elastic modulus (G'30) may be less than $1\times10^5$ Pa, and the loss elastic modulus (G"30) may be less than $1\times10^5$ Pa. It is however preferable that with respect to the hardness of the overall toner, at the angular frequency of 1 rad/sec and 30° C., the storage elastic modulus (G'30) is at least $1\times10^5$ Pa and the loss elastic modulus (G"30) is at least $1\times10^5$ Pa.

The binder resin used in the invention has to have the melting point in the temperature region of 45 to 110° C. The crystalline resin abruptly decreases the viscosity outside the melting point. Therefore, when it is stored above this melting point, blocking occurs. Thus, the binder resin has to have a melting point that is a temperature to which it is exposed during storage or in use, namely a melting point of 45° C. or more. Meanwhile, when the melting point is higher than 110° C., the low-temperature fixing cannot be achieved. The melting point can be measured as a melting peak temperature by the input compensation differential scanning calorimetry shown in JIS K-7121. Incidentally, a crystalline resin sometimes shows plural melting peaks, and the maximum peak is regarded as a melting point.

In the toner of the invention, it is required that the values of the storage elastic modulus (G') and the loss elastic modulus (G") have an area which is changed by two or more figures at a temperature of 10° C. Unless the values of the storage elastic modulus (G') and the loss elastic modulus (G") have an area which is changed by two or more figures at a temperature of 10° C., it is impossible to provide an electrophotographic toner composition which can allow the fixing at a low temperature, which reduce the energy consumption in the fixing step and which has a wide fixing latitude.

As the binder resin used in the invention, any resin is available so long as the conditions are satisfied. Examples of the binder resin are described below.

As a preferable example of a polymer constituting the crystalline resin used in the invention, a resin including an acrylic monomer having a long-chain alkyl group and a divinyl monomer can be mentioned.

As the monomer used here, an acrylic monomer having a long-chain alkyl group, preferably an alkyl group with 10 or more carbon atoms is mentioned. Specific examples thereof include lauryl acrylate, stearyl acrylate, behenyl acrylate, lauryl methacrylate, stearyl methacrylate and behenyl methacrylate. The acrylic monomer is not limited thereto so long as it has a long-chain alkyl group, preferably an alkyl group with approximately 10 to 24 carbon atoms. Further, an acrylic monomer having a long-chain ether group or a polyester group instead of the long-chain alkyl group is also available.

Further, the divinyl monomer may contain two vinyl groups in one monomer unit. Examples of the divinyl monomer include divinylstyrene, acrylate esters such as propylene glycol dimethacrylate, ethylene glycol dimethacrylate, polyethylene glycol dimethacrylate and 5-ethyl-2-hydroxy-1,1-dimethylethyl-5-hydroxymethyl-1,3-dioxane, and N,N-methylenebisacrylamide.

Moreover, the binder resin used in the invention is a crystalline resin capable of forming the crosslinked structure, and further a monomer other than this monomer can be used in combination as a copolymerizable monomer component unless the effects of the invention are impaired. Examples of the other copolymerizable monomer component include styrenes such as styrene, o-methylstyrene, m-methylstyrene, p-methylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-phenylstyrene, p-chlorostyrene and 3,4-dichlorostyrene; ethylenically unsaturated monoolefins such as ethylene, propylene, butylene and isobutylene; vinyl halides such as vinyl chloride, vinylidene chloride, vinyl bromide and vinyl fluoride; vinyl esters such as vinyl acetate, vinyl propionate and vinyl acetate; acrylic acid; α-methylene aliphatic monocarboxylic acid esters such as methyl acrylate, ethyl acrylate, n-butyl acrylate, trifluoroethyl acrylate, hexafluoroisopropyl acrylate, tetrafluoropropyl acrylate, octafluoropentyl acrylate, heptadecaflurodecyl acrylate, methyl methacrylate, ethyl methacrylate and tetrafluoropropyl methacrylate; vinyl ethers such as vinylmethyl ether; vinyl ketones such as vinyl methyl ketone; and N-vinyl compounds such as N-vinylpyrrole, N-vinylcarbazole, N-vinylindole and N- vinylpyrrolidone.

The amounts of these can appropriately be selected according to the desired characteristics of the binder resin and the type of the main acrylic monomer having the long-chain alkyl group, the ether group or the ester group. The upper limit thereof is usuallyapproximately 60%, preferably between approximately 20 and 50%.

Further, as the other crystalline resin which is appropriate for the binder resin of the invention, a polyester resin can be mentioned. The polyester resin is obtained by, for example, the reaction of a dibasic or tribasic or higher carboxylic acid and a dihydric or trihydric or higher alcohol. Incidentally, in the invention, as the polyester resin, a commercial product or a product that is produced as required may be used. Examples of the dibasic carboxylic acid include dibasic acids such as oxalic acid, succinic acid, glutaric acid, adipic acid, suberic acid, azelaic acid, sebacic acid, phthalic acid, isophthalic acid, terephthalic acid, naphthalene- 2,6-dicarboxylic acid, naphthalene-2,7-dicarboxylic acid, cyclohexanedicarboxylic acid, malic acid and mesaconic acid, and anhydrides and lower alkyl esters thereof; and aliphatic unsaturated dicarboxylic acids such as maleic acid, fumaric acid, itaconic acid and citraconic acid. Examples of the tribasic or higher carboxylic acid include 1,2,4- benzenetricarboxylic acid, 1,2,5-benzenetricarboxylic acid, 1,2,4-naphthalenetricarboxylic acid, and anhydrides and lower alkyl esters thereof. These may be used either singly or in combination. Examples of the dihydric alcohol include bisphenol A, hydrogenated bisphenol A, ethylene oxide or/and propylene oxide adducts of bisphenol A, 1,4-cyclohexanediol, 1,4-cyclohexanedimethanol, ethylene glycol, diethylene glycol, propylene glycol, dipropylene glycol, 1, 3-butanediol, 1,4-butanediol, 1,5-pentanediol, 1,6-hexanediol, neopentyl glycol and xylylene glycol. Examples of the trihydric or higher alcohol include glycerin, trimethylolethane, trimethylolpropane and pentaerythritol. These may be used either singly or in combination. For adjusting an acid value or a hydroxyl value, a monobasic acid such as acetic acid and benzoic acid and a monohydric alcohol such as cyclohexanol or benzyl alcohol can be used as required.

The crosslinked structure can be formed in the crystalline resin by adding a crosslinkable ingredient such as anisocyanate-containing compound to anacrylic resin having a long-chain alkyl group or a polyester resin.

In order to form a good crosslinked structure, it is advisable to use at least a trifunctional ingredient. For forming a preferable crosslinked structure, it is advisable to employ, for example, a method using a combination of a resin containing a diol component and a triisocyanate, a method using a combination of a resin containing a triol component and a diisocyanate or a method in which a functional group such as a vinyl group is introduced into a main chain during synthesis of a polyester resin and this is reacted with a monomer having a vinyl group.

The colorant used in the toner of the invention is not particularly limited, and a colorant which is known per se can be mentioned. It can appropriately be selected according to the purpose.

Examples of the colorant include carbon blacks such as furnace black, channel black, acetylene black and thermal black; inorganic pigments such as red oxide, Prussian blue and titanium oxide; azo pigments such as fast yellow, diazo yellow, pyrazolone red, chelate red, brilliant carmine and Para Brown; phthalocyanine pigments such as copper phthalocyanine and non-metallic phthalocyanine; fused polycyclic pigments such as flavanthrone yellow, dibromoanthrone orange, perylene red, quinacridone red and dioxazine violet. Further, a disperse dye and an oil-soluble dye can also be used.

The content of the colorant in the electrophotographic toner is preferably between 1 and 30 parts by weight per 100 parts by weight of the binder resin. However, it is advisable that the content is as high as possible unless the smoothness of the image surface after fixing is impaired. When the content of the colorant is increased, the thickness of the image can be decreased in obtaining the image of the same density. It is advantageously effective for prevention of offset. By the way, a yellow toner, a magenta toner, a cyan toner or a black toner is obtained by selecting the color of the colorant.

In the toner of the invention, known additives can be used as ingredients other than the essential ingredients, as required. Various additives known per se, such as inorganic fine particles, organic fine particles, an antistatic agent and a release agent are mentioned.

Examples of the inorganic fine particles include silica, alumina, titanium oxide, barium titanate, magnesium titanate, calcium titanate, strontium titanate, zinc oxide, silica sand, clay, mica, wollastonite, diatomaceous earth, ceriumchloride, red oxide, chromium oxide, cerium oxide, antimony trioxide, magnesium oxide, zirconium oxide, silicon carbide and silicon nitride. of these, silica fine particles are preferable, and hydrophobic silica particles are especially preferable. The inorganic fine particles are generally used to improve a fluidity. The primary particle diameter of the inorganic fine particles is preferably between 1 and 1,000 nm, and the amount thereof is preferably between 0.01 and 20 parts by weight per 100 parts by weight of the toner.

Examples of the organic fine particles include polystyrene, polymethyl methacrylate and polyvinylidene fluoride. The organic fine particles are generally used for improving a cleanability or a transferability.

Examples of the antistatic agent include a metal salicylate, a metal-containing azo compound, nigrosine and a quaternary ammonium salt. The antistatic agent is generally used for improving a charging property.

Examples of the release agent include paraffin waxes such as low-molecular polypropylene and low-molecular polyethylene, a silicone resin, a rosin and rice wax. The release agent is generally used for improving a releasability.

The toner particles are produced by a step of dispersing a colorant, non-magnetic inorganic fine particles and other substances used as required in the binder resin to form toner particles and a step of forming a surface layer on the surfaces of the toner particles as required. Specifically, a known method of pulverizing a toner material made of a binder resin containing a crystalline resin as a main ingredient, a colorant, non-magnetic inorganic fine particles and other substances is used.

That is, the toner particles may be formed by a kneading pulverization method, a suspension polymerization method in which particles obtained by dispersing a monomer of a binder resin, a colorant, non-magnetic inorganic fine particles and other substances in an aqueous medium are polymerized or an emulsion coagulation method in which emulsion particles of a binder resin are coagulated along with a colorant, non-metallic inorganic fine particles and other substances. In case of the emulsion coagulation method, emulsion particles may be particles formed by emulsion polymerization, or particles obtained by dissolving a binder resin in a solvent and finely dispersing the solution in an aqueous medium. Further, a method may be employed in which a binder resin, a colorant, non-magnetic inorganic fine particles and other substances are dissolved and dispersed in a solvent, and suspended in an aqueous medium, after which the solvent is removed. Still further, a method may be employed in which a binder resin, a colorant, non-magnetic inorganic fine particles and other substances are dissolved and dispersed in a solvent, and dispersed in air with a spray drier, and the solvent is removed simultaneously. Furthermore, a method may be employed in which a binder resin dissolved in a solvent is precipitated by decreasing a temperature or adding a poor solvent. Moreover, a method may be employed in which a molten material is dispersed and cooled in a medium. In addition, a dispersion polymerization or seed polymerization method may be employed.

Of these methods, a method in which a binder resin, a colorant, non-metallic inorganic fine particles and other substances are dissolved and dispersed in a solvent, and suspended in an aqueous medium, after which the solvent is removed can generally form particles by selecting an appropriate solvent regardless of the type of the resin. Thus, it is appropriate as the method of the invention.

The thus-formed toner particles have preferably the particle diameter of 1 to 20 $\mu$m.

In the toner particles of the invention, the surface may be covered with the surface layer. It is advisable that the surface layer does not greatly influence dynamic properties and a melt viscoelasticity of the overall toner. For example, when a non-molten or high-melting surface layer covers the toner thick, the low-temperature fixing property of the crystalline resin is hardly exhibited. Thus, it is advisable that the film thickness of the surface layer is small. The preferable film thickness of the surface layer is in the range of 0.001 to 0.5 $\mu$m.

The surface layer may be formed on the surfaces of the toner particles by a known technique. For example, an interfacial polymerization method, an in-situ polymerization method, a submerged cure-coating method, a core salvation method, a submerged drying method, a melt-dispersion cooling method, a spray-drying method and a dry-mixing method described in Biryushi Sekkei (compiled by Koishi M., Kogyo Chosakai, 1987) and *Microcapsule—Its Performance and Application* (compiled by Kondo T., Nippon Kikaku Kyokai, 1991) can be used. The surface layer may be formed either after, or simultaneously with, the formation of the toner particles by the method.

In order to form the thin surface layer, a method in which the surfaces of the toner particles containing the binder resin, the colorant, the non-magnetic inorganic fine particles and the other substances are chemically treated can preferably be used. Further, it is preferable that a polar group is introduced into a component constituting the surface layer, and an adhesion between the toner and the material for transfer such as paper is increased by the chemical binding of the polar group. As the polar group, any polarizing functional group will do. Examples thereof include a carboxyl group, a carbonyl group, an epoxy group, an ether group, a hydroxyl group, an amino group, an imino group, a cyano group, an amido group, an imido group, an ester group and a sulfone group. Examples of the chemical treatment method include a method in which oxidation is conducted with a strong oxidizing agent such as a peroxide, ozone or plasma, and a method in which a polymerizable monomer containing a polar group is bound through graft polymerization. The chemical treatment enables the polar group to be firmly bound to the molecular chain of the crystalline resin through a covalent bond.

In the toner of the invention, a charging substance may further be adhered to the surfaces of the toner particles chemically or physically. Further, fine particles of a metal, a metal oxide, a metal salt, ceramics, a resin and carbon black may externally be added for improving a charging property, an electroconductivity, a powder fluidity and a lubricity.

The image-forming method using the toner composition in the invention is described below. The image-forming method includes a step of forming an electrostatic latent image on a latent image holding body, a step of developing the latent image using a developer supported on a developer carrier, a step of transferring a toner image formed on the latent image holding body onto a material for transfer such as paper, and a step of heat-fixing the toner image on the material for transfer. As the developer, the toner composition is used. Known steps in an image-forming method can be utilized in any of the steps of the invention. As the latent image holding body, an electrophotographic photoreceptor and a dielectric recording body can be used. For example, in case of an electrophotographic photoreceptor, charging is conducted with a corotron charging unit or a contact charging unit, and exposure is conducted to form an electrostatic latent image. Subsequently, it is contacted with, or brought near to, a development roller on which surface a developer layer is formed to adhere toner particles to the electrostatic latent image, whereby a toner image is formed on the electrophotographic photoreceptor. The toner image formed is transferred onto the material for transfer such as paper using the corotron charging unit, and heat-fixed with a fixing device to form the toner image.

In the heat-pressing, a large amount of a release agent is usually fed to the fixing member for preventing offset. Meanwhile, when the image is formed using the developer containing the electrophotographic toner of the invention, the fixing is possible in the absence of the release agent because the offset resistance of the electrophotographic toner of the invention is quite excellent.

The absence of the release agent is preferable. However, when the feed amount of the release agent is 0 mg/cm$^2$, the wear of the fixing member is increased in contacting the fixing member with the material for transfer such as paper during the fixing step, decreasing the durability of the fixing member. Accordingly, it is practically preferable that the release agent is fed to the fixing member in a small amount. Meanwhile, when the feed amount of the release agent exceeds $8.0\times10^{-3}$ mg/cm$^2$, the image quality is decreased owing to the release agent adhered to the image surface after the fixing. Especially, this appears notably when transmitted light such as OHP is used. Further, the notable adhesion of the release agent to the material for transfer leads to occurrence of stickiness. Moreover, there arise problems that when the feed amount of the release agent is increased, a volume of a tank for storing the release agent is increased and the size of the fixing device is increased. Thus, it is undesirable.

The release agent is not particularly limited. Examples thereof include liquid release agents such as dimethylsilicone oil, fluorine oil, fluorosilicone oil and modified oil, for example, amino-modified silicone oil. Of these, modified oil, for example, amino-modified silicone oil is preferable for adsorbing the release agent on the surface of the fixing member to form a uniform release agent layer, and fluorine oil and fluorosilicone oil are preferable and ideal for forming a uniform release agent layer because of a good wettability to the fixing member. When fluorine oil or fluorosilicone oil is used as the release agent, the feed amount of the release agent cannot be reduced in case of the ordinary image-forming method, which is thus not practical in view of the cost. However, in the image-forming method of the invention, the feed amount of the release agent can be reduced much, and it is not problematic in the cost.

A method of feeding the release agent to the surface of the heating roller in the heat-pressing device is not particularly limited. Examples thereof include a padding method in which a liquid release agent is impregnated, a web method, a roller method and a non-contact-type shower method (spray method). Of these, a web method and a roller method are preferable. These methods are advantageous because the release agent can uniformly be fed and the feed amount is easily controlled. When the release agent is uniformly fed to the overall fixing member by the shower method, a blade has to be separately used.

The feed amount of the release agent here is measured as follows. That is, when common paper (typically, copying paper made by Fuji Xerox, trade name—J paper) used ina general copier is passed through the fixing member to which surface the release agent has been fed, the release agent is adhered to the common paper. The release agent on the common paper is extracted with a Soxhlet extractor. Hexane is used as a solvent. The release agent contained in this hexane is quantitatively measured by an atomic absorption analyzer to measure the amount of the release agent adhered to the common paper. This amount is defined as a feed amount of the release agent to the fixing member.

Examples of the material for transfer (recording material) used in the image-forming method of the invention include common paper and OHP sheet used in an electrophotographic copier or printer. In order to further improve the smoothness of the image surface after the fixing, it is preferable that the surface of the material for transfer is also as smooth as possible. For example, coated paper obtained by coating the surface of common paper with a resin and art paper for printing can preferably be used as the material for transfer.

In the electrophotographic toner of the invention and the image-forming method using the same in the invention, the intensity of the image after the fixing is high, and almost no adhesion of the release agent to the material for transfer is observed. Accordingly, the image is formed using the material for transfer to which reverse side the stickiness is imparted, such as a seal or a tape, whereby a seal or a sticker having formed thereon a high-density and high-quality image can be produced.

Further, as stated above, the electrophotographic toner of the invention can provide a high-quality color image having a wide fixing latitude with low-temperature fixing and having a vivid color by introducing a crosslinked structure in a crystalline resin. Moreover, owing to the excellent releasability from the surface of the fixing device, the fixing can be conducted by reducing an amount of the release agent such as oil or in the absence of the release agent. Accordingly, it is possible to reduce the cost of the fixing device or to downsize the fixing device. Since the thickness of the elastic layer of the fixing member is reduced, energy saving is enabled. In addition, since the image-forming method of the invention uses the electrophotographic toner of the invention, it is possible to downsize the fixing device or reduce the cost of the device, and a high-quality image can be formed with a small amount of energy.

EXAMPLES

The invention is illustrated specifically with reference to the following Examples and Comparative Examples. However, the invention is not limited thereto.

Example 1

<Production Example of a toner>

(1) Synthesis and purification of a crosslinked resin

A 100-milliliter flask is charged with 30 g of stearyl acrylate, 0.168 g (1 mol % based on stearyl acrylate) of 1,4-butanediol diacrylate, 0.3065 g (2 mol % based on the monomer) of 2,2'-azoisobutylonitrile, 12.07 g of a cyan pigment (C. I. pigment blue 15:3) ethyl acetate-toluene mixed solution (cyan pigment 20% by weight) and 3.3 ml of toluene, and these are dissolved. The resulting solution is bubbled with a nitrogen gas, and then reacts at 60° C. for 24 hours. The thus-obtained gel is milled with a homogenizer (AM-6, supplied by Nippon Seiki) for 5 minutes, and charges into 500 ml of methanol. The mixture is allowed to stand for approximately 1 hour, and shrunk. The supernatant methanol is removed through decantation, and 500 ml of toluene is added to the residue for swelling. The swollen gel is charged into 500 ml of methanol. The mixture is allowed to stand, and shrunk. This procedure is repeated until the colorant of the decantation liquid almost disappeared. Subsequently, drying is conducted at 30° C. under reduced pressure for 24 hours.

(2) Milling

The crosslinked resin thus dried is milled with a jet mill (table jet mill supplied by Powder Tech) at a pressure of 7 to $8\times10^5$ Pa. The resulting fine particles are passed through a filter of 45 $\mu$m to remove coarse particles. With respect to the fine particles, the particle size distribution is measured with a Coulter counter.

(3) Analysis

Measurement of an amount of a colorant

The composition of the crosslinked resin formed is basically made of a colorant and a binder resin. The amount of the colorant is adjusted to 8% by weight in the polymerization, but the colorant is removed in the wet milling and the cleaning. An interrelation of the crosslink density and the removal of the colorant in the cleaning is considered. The actual content of the pigment is measured by the quantitative analysis of a fluorescent X-ray intensity of the pigment (copper phthalocyanine) in the sample to Cu.

Approximately 200 mg of the sample is accurately measured as a pellet sample using an IR tablet molding unit having a diameter of 13 mm. Separately, a calibration curve is prepared with a sample obtained by fully dispersing copper phthalocyanine in linear stearyl acrylate in an amount of 4% by weight, 8% by weight or 12% by weight. The quantitative analysis is conducted using this calibration curve. In order to identify that there is almost no error in measuring the weight of the sample, it is identified that the difference in the fluorescent X-ray yield is not observed among 180 mg, 200 mg and 220 mg of samples containing 8% by weight of copper phthalocyanine which are accurately measured.

Measurement of a melting point

The melting point is measured using a thermal analyzer of a differential scanning calorimeter (DSC 3110, Thermal Analysis System 001 supplied by Mac Science; hereinafter abbreviated as "DSC") F The measurement is conducted at a rate of temperature rise of 10° C./min from room temperature to 150° C., and a melting point is measured by analysis according to JIS standard.

Measurement of a viscoelasticity

The viscoelasticity is measured using a rotary flat-type rheometer (RDA 2RHIOS System ver. 4.3.2) supplied by Rheometrix Scientific F. E. The measurement is conducted by setting a sample at a sample holder under conditions that a rate of temperature rise is 1° C./min, a frequency is 1 rad/s, a distortion is less than 20% and a detection torque is within a measurement proof value. The size of the sample holder is adjusted to 8 mm and 20 mm as required. The changes in the storage elastic modulus G' (Pa) and the loss elastic modulus G" (Pa) according to the change in the temperature are obtained.

Examples 2, 3 and 4

Toners were produced in the same manner as in Example 1 except that the amount of the crosslinking agent and the molar amount of acrylic acid based on stearyl acrylate are changed as shown in Table 1.

Comparative Examples 1 and 2

Toners were produced in the same manner as in Example 1 except that the crosslinking agent is not added.

The composition of the toners obtained in Examples 1, 2, 3 and 4, Comparative Examples 1 and 2, the amount of the colorant, the properties such as an average particle diameter, a melting point and a viscoelasticity measured as in Example 1 and the analytical results are shown in Table 1.

TABLE 1

| | | Ex. 1 | Ex. 2 | Ex. 3 | Ex. 4 | CEx. 1 | CEx. 2 |
|---|---|---|---|---|---|---|---|
| Monomer | stearyl acrylate | 100 mol % | 100 mol % | 70 mol % | 100 mol % | 100 mol % | — |
| | acrylic acid | — | — | 30 mol % | 30 mol % | — | — |
| | t-butyl acrylate | — | — | — | — | — | 100 mol % |
| | styrene | — | — | — | — | — | — |
| Cross-linking agent[1] | 1,4-butandiol diacrylate | 1 mol % | 0.2 mol % | 1 mol % | 0.2 mol % | — | — |
| Properties of a toner | Amount of colorant (mol %) | 8.3 | 6.4 | 9.3 | 7.4 | 7.1 | 8.3 |
| | Average particle diameter ($\mu$m) | 8.1 | 8.3 | 7.9 | 7.2 | 7.5 | 8.2 |
| | Melting point (Tm) (° C.) | 46 | 46 | 47 | 48 | 47 | 45 (Tg)*2 |
| | G' (Pa, 30) | $5.0\times10^5$ | $3.0\times10^5$ | $5.0\times10^8$ | $2.0\times10^8$ | $1.2\times10^8$ | $1.1\times10^9$ |
| | G" (Pa, 30) | $1.8\times10^5$ | $2.0\times10^5$ | $1.8\times10^7$ | $1.2\times10^7$ | $1.2\times10^7$ | $2.0\times10^8$ |
| | \|logG' (Tm) − logG' (Tm + 10)\| | 2.26 | 2.40 | 4.00 | 4.11 | 5.54 | 1.80 |
| | \|logG" (Tm) − logG" Tm + 10)\| | 2.74 | 2.90 | 2.90 | 3.31 | 4.69 | 1.73 |
| | \|logG' (Tm + 20) − log" Tm + 50)\| | 0.03 | 0.10 | 0.21 | 0.80 | 0.19 | 2.20 |
| | \|logG" Tm + 20) − logG" Tm + 40)\| | 0.18 | 0.23 | 0.52 | 0.65 | 0.21 | 2.30 |
| | tan δ (Tm + 20) | 0.12 | 0.54 | 0.16 | 1.38 | 1.54 | 1.92 |
| | G' (Pa, Tm + 20° C.) | $8.3\times10^4$ | $1.5\times10^4$ | $1.2\times10^4$ | $4.1\times10^3$ | $1.9\times10^2$ | $5.3\times10^3$ |
| | G" (Pa, Tm + 20° C.) | $1.0\times10^4$ | $8.1\times10^2$ | $1.9\times10^3$ | $5.7\times10^3$ | $2.9\times10^2$ | $1.0\times10^3$ |

Ex. - Example, CEx. - Comparative Example

*1Molar ratio based on the monomer.

*2A value of Tg (45° C.) was used instead of Tm.

<Evaluation of properties of a toner>

The image formation is conducted using the electrophotographic toners obtained in Examples 1, 2, 3 and 4 and Comparative Examples l and 2, and the f ol lowing evaluation is carried out.

Test for a fixing property

The image formation is conducted with an Acolor full color copier of Fuji Xerox equipped with a remodeled fixing device using the electrophotographic toners, and the fixing property of the electrophotographic toners is evaluated. The conditions of the test for the fixing property are shown below.

(Conditions of the test for the fixing property)

Toner image: Solid image (3 cm×3 cm)

Paper: Color paper made by Fuji Xerox (J paper)

OHP: made by Fuji Xerox

Feed rate: 160 mm/sec in case of paper 40 mm/sec in case of OHP

Oil: Coating amount of silicone oil $1.6\times10^{-3}$ mg/cm$^2$

The results of the test for the fixingpropertyare shown in Table 2. In Table 2, A, B and C indicate the following.

A: No problem.

B: There was actually no problem though change was slightly observed.

C: Great change was observed.

TABLE 2

| | | Fixing temperature | Ex. 1 | Ex. 2 | Ex. 3 | Ex. 4 | CEx. 1 | CEx. 2 |
|---|---|---|---|---|---|---|---|---|
| Offset | Oil | 110° C. | B | A | A | A | B | B |
| | | 150° C. | A | A | A | A | B | B |
| | No oil | 110° C. | B | A | A | A | C | C |
| | | 150° C. | B | A | A | A | C | C |
| Crease | Oil | 110° C. | 80 | 60 | 60 | 20 | 110 or more | 110 or more |
| | | 150° C. | 80 | 60 | 40 | 20 or less | 110 | 110 |
| | No oil | 110° C. | 110 | 60 | 80 | 20 | — | — |
| | | 150° C. | 80 | 40 | 80 | 20 or less | — | — |
| OHP projection property | | | A | A | A | A | C | C |
| Permeation in paper by observation of section | | | A | A | A | A | C | C |

Ex. - Example, CEx. - Comparative Example

The results in Table 2 reveal the following. Since the electrophotographic toners of the invention have the excellent releasability, the offset does not occur in Examples 1, 2, 3 and 4 even with the use of the silicone oil in the fixing, whereas the offset is slightly observed in Comparative Examples 1 and 2. When the silicone oil is absent in the fixing, the offset is slightly observed in Example 1, but the offset does not occur in Examples 2, 3 and 4 in which the amounts of the crosslinking agent and the copolymerizable component are adjusted. Meanwhile, the winding on the heating roller and the offset occur in Comparative Examples 1 and 2. The crease is also improved, and Example 4 shows the high fixing property with the crease of 20. The good results are also obtained with respect to the OHP projection property and the permeation in paper by observation of the section.

The results in Examples 1, 2, 3 and 4 reveal that the improvements in the effects are observed in the products in which the crosslinking property is adjusted by decreasing the amount of the crosslinking agent and a copolymer is formed with acrylic acid and especially Example 4 in which the amount of the crosslinking agent is small and the acrylic acid component is copolymerized exhibits the best results.

What is claimed is:

1. A toner comprising a crosslinked binder resin and a colorant, the toner satisfies the following properties (a) to (e):

(a) a melting point is in the temperature range of about 45 to 110° C.;

(b) at an angular frequency of 1 rad/sec and 30° C., a storage elastic modulus (G'30) is at least $1\times10^5$ Pa and a loss elastic modulus (G"30) is at least $1\times10^5$ Pa;

(c) the values of the storage elastic modulus (G') and the loss elastic modulus (G") are changed $10^2$ or more within a temperature range of about 10° C. when the temperature is varied;

(d) when the storage elastic modulus at a temperature of melting point plus 20° C. is represented by G' (Tm+20) and the storage elastic modulus at a temperature of melting point plus 50° C. is represented by G' (Tm+50), the condition of the following formula (1) is satisfied $$|logG'(Tm+20)-logG'(Tm+50)|\leqq 1.5 \quad (1); \text{ and}$$

(e) when the loss elastic modulus at a temperature of melting point plus 20° C. is represented by G" (Tm+20) and the loss elastic modulus at a temperature of melting point plus 50° C. is represented by G" (Tm+50), the condition of the following formula (2) is satisfied $$|logG''(Tm+20)-logG''(Tm+50)|\leqq 1.5 \quad (2).$$

2. The electrophotographic toner as claimed in claim 1, wherein the binder resin is a crosslinked crystalline resin.

3. The electrophotographic toner as claimed in claim 2, wherein a loss tangent (tanδ) at a temperature of melting point plus 20° C. is less than about 1.5 at the angular frequency of 1 rad/sec.

4. The electrophotographic toner as claimed in claim 3, wherein the loss tangent (tanδ) satisfies 0.01<tanδ<1.

5. The electrophotographic toner as claimed in claim 1, wherein at least one of the storage elastic modulus at a temperature of melting point plus 20° C., G' (Tm+20), and the loss elastic modulus at a temperature of melting point plus 20° C., G" (Tm+20), is at least 10 Pa.

6. The electrophotographic toner as claimed in claim 5, wherein at least one of the storage elastic modulus at a temperature of melting point plus 20° C., G' (Tm+20), and the loss elastic modulus at a temperature of melting point plus 20° C., G" (Tm+20), is at least 100 Pa.

7. The electrophotographic toner as claimed in claim 1, wherein the binder resin having a melting point in the temperature region of about 45 to 110° C.

8. The electrophotographic toner as claimed in claim 1, wherein the binder resin is a polyester resin or a styrene-acrylic resin.

9. The electrophotographic toner as claimed in claim 1, wherein the binder resin having an alkyl group with 10 or more carbon atoms.

10. The electrophotographic toner as claimed in claim 9, wherein the binder resin having an alkyl group with approximately 10 to 24 carbon atoms.

11. A two-component developer comprising a toner and a carrier, in which the toner is the toner as claimed in claim 1.

12. The two-component developer as claimed in claim 11, wherein the carrier has a resin coating layer.

13. An image-forming method comprising a latent image forming step of forming a electrostatic latent image on a latent image holding member, a developing step of developing the latent image with a toner to form a toner image, and a fixing step of fixing the toner image onto an image receiving object, the toner as claimed in claim 1 being used in the developing step.

14. The image- forming method as claimed in claim 13, wherein the fixing step is conducted using a fixing roller in which a feed amount of a release agent fed to the fixing roller is $8.0\times10^{-3}$ mg/cm$^2$ or less.

* * * * *